US009099783B2

(12) United States Patent
Johansson

(10) Patent No.: US 9,099,783 B2
(45) Date of Patent: Aug. 4, 2015

(54) TENSIONING DEVICE FOR TENSIONING A RADOME FABRIC

(71) Applicant: Induflex AB, Karlstad (SE)

(72) Inventor: Göran Johansson, Kil (SE)

(73) Assignee: INDUFLEX AB, Karlstad (SE)

( * ) Notice: Subject to any disclaimer, the term of this patent is extended or adjusted under 35 U.S.C. 154(b) by 0 days.

(21) Appl. No.: 13/851,366

(22) Filed: Mar. 27, 2013

(65) Prior Publication Data

US 2013/0255166 A1 Oct. 3, 2013

(30) Foreign Application Priority Data

Mar. 27, 2012 (SE) ..... 1250302

(51) Int. Cl.
*E04B 1/12* (2006.01)
*H01Q 1/42* (2006.01)

(52) U.S. Cl.
CPC ..... *H01Q 1/427* (2013.01)

(58) Field of Classification Search
CPC ..... H01Q 1/427; B44D 3/185; D05C 1/02
USPC ..... 52/63, 222, 223.1, 223.3, 223.14, 273; 38/102.91; 40/606.12; 160/371–382; 343/872
See application file for complete search history.

(56) References Cited

U.S. PATENT DOCUMENTS 1,990,804 A * 2/1935 Watson ..... 135/128
2,188,213 A * 1/1940 Wilson ..... 135/95
2,401,044 A * 5/1946 Brandt ..... 160/380
2,521,550 A * 9/1950 Smith ..... 343/742
3,475,768 A * 11/1969 Burton ..... 4/500
3,540,170 A * 11/1970 Flowers ..... 52/2.19
3,754,267 A * 8/1973 Walters et al. ..... 343/705
3,780,639 A * 12/1973 Wood ..... 454/45
3,889,698 A * 6/1975 Roessl ..... 135/94
3,994,108 A * 11/1976 Johnson ..... 52/247
4,010,580 A * 3/1977 Mayr et al. ..... 52/223.3
4,148,850 A * 4/1979 Schulte et al. ..... 261/109
4,199,906 A * 4/1980 Jasch et al. ..... 52/63
4,224,754 A * 9/1980 Derryberry ..... 43/1
4,326,363 A * 4/1982 Leonhardt et al. ..... 52/223.3
4,377,812 A * 3/1983 Gobel et al. ..... 343/872

(Continued)

FOREIGN PATENT DOCUMENTS

EP 1 054 470 11/2000
FR 2 544 553 10/1984
WO WO 2009/131219 10/2009

OTHER PUBLICATIONS

International Search Report dated Jun. 10, 2013 issued in PCT International Patent Application No. PCT/SE2013/050322, 4 pp.

*Primary Examiner* — Brian Glessner
*Assistant Examiner* — Paola Agudelo
(74) *Attorney, Agent, or Firm* — Nixon & Vanderhye P.C.

(57) ABSTRACT

A tensioning device for tensioning a radome fabric (7, 8), which device comprises a substantially circular, upper tensioning profile (3, 5) and a substantially circular, lower tensioning profile (4, 6), which is disposed in parallel with and axially displaced relative to the upper tensioning profile, between which tensioning profiles the radome fabric is tensioned in order to form a radome (1), wherein at least one of the tensioning profiles (3, 4, 5, 6) comprises a fabric contact portion (9), which exhibits a convex contact surface (10) for interacting with an edge portion of the radome fabric.

9 Claims, 3 Drawing Sheets

(56) References Cited

U.S. PATENT DOCUMENTS

| | | | | | |
|---|---|---|---|---|---|
| 4,388,785 | A | * | 6/1983 | Queffelec et al. | 52/222 |
| 4,520,600 | A | * | 6/1985 | Bordet | 52/83 |
| 4,623,895 | A | * | 11/1986 | Bowering | 343/829 |
| 4,694,543 | A | * | 9/1987 | Conley | 24/461 |
| 4,761,908 | A | * | 8/1988 | Hayes | 43/1 |
| 5,033,240 | A | * | 7/1991 | Richard et al. | 52/63 |
| 5,072,553 | A | * | 12/1991 | Bozetto et al. | 52/63 |
| 5,261,193 | A | * | 11/1993 | Wieber et al. | 52/63 |
| 5,392,056 | A | * | 2/1995 | DeTeso | 343/873 |
| 5,408,770 | A | * | 4/1995 | Suzuki | 38/102 |
| 5,444,943 | A | * | 8/1995 | Schelfhorst | 52/63 |
| 5,586,400 | A | * | 12/1996 | Moore, III | 38/102.2 |
| 5,617,681 | A | * | 4/1997 | Lyons | 52/82 |
| 5,794,528 | A | * | 8/1998 | Gronig et al. | 101/127.1 |
| 5,860,258 | A | * | 1/1999 | Faith et al. | 52/236.2 |
| 5,872,547 | A | | 2/1999 | Martek | |
| 5,913,496 | A | * | 6/1999 | Valdez | 248/99 |
| 6,209,240 | B1 | * | 4/2001 | Engle | 38/102.91 |
| 6,360,496 | B1 | * | 3/2002 | Raccuglia | 52/169.1 |
| 7,271,759 | B1 | * | 9/2007 | Bofinger et al. | 342/3 |
| 7,418,771 | B2 | * | 9/2008 | Hori | 24/530 |
| 7,699,091 | B2 | * | 4/2010 | Fisher et al. | 160/397 |
| 8,125,403 | B2 | * | 2/2012 | Hager | 343/890 |
| 2004/0168383 | A1 | * | 9/2004 | Reynolds et al. | 52/273 |
| 2005/0030250 | A1 | | 2/2005 | Gottl et al. | |
| 2005/0229446 | A1 | * | 10/2005 | Bagley | 38/102.91 |
| 2007/0021095 | A1 | * | 1/2007 | Cheng et al. | 455/403 |
| 2008/0036683 | A1 | | 2/2008 | Schadler | |

* cited by examiner

TENSIONING DEVICE FOR TENSIONING A RADOME FABRIC

This application claims priority to Swedish Patent Application No. 1250302-5 filed 27 Mar. 2012, the entire content of which is hereby incorporated by reference.

The present invention relates to a tensioning device for tensioning a radome fabric.

A radome is used for protecting antennas or other electronic equipment. The radome comprises a support frame, formed by a framework. The support frame carries a number of tensioning profiles which, in pairs, support and tension a radome fabric, so that the object that is to be protected is located inside the radome fabric. The radome fabric is suitably made of a rubber or plastic material that is permeable to radio waves.

It is a problem that the edge portions of the radome fabric, wherein the edge portions are attached to the tensioning profiles, are subjected to large forces, which means that the radome fabric runs the risk of tearing.

The object of the present invention is to solve this problem and to produce a device for tensioning a radome fabric that reduces the risk of the radome fabric tearing.

The tensioning device according to the invention is characterized in that it comprises a substantially circular, upper tensioning profile, and a substantially circular, lower tensioning profile, which is disposed in parallel with and axially displaced relative to the upper tensioning profile, between which tensioning profiles the radome fabric its tensioned in order to form a radome, wherein at least one of the tensioning profiles comprises a fabric contact portion, which comprises a convex contact surface for interacting with an edge portion of the radome fabric.

In the following detailed description, the term radome fabric will be used. As used herein, the term radome fabric means a flexible material that is permeable to radio waves. The material in the radome fabric is suitably constituted by a rubber or plastic material. A particularly preferred material is a GORE material.

In the following, the invention will be described more closely with reference to accompanying drawings.

Figure 1:
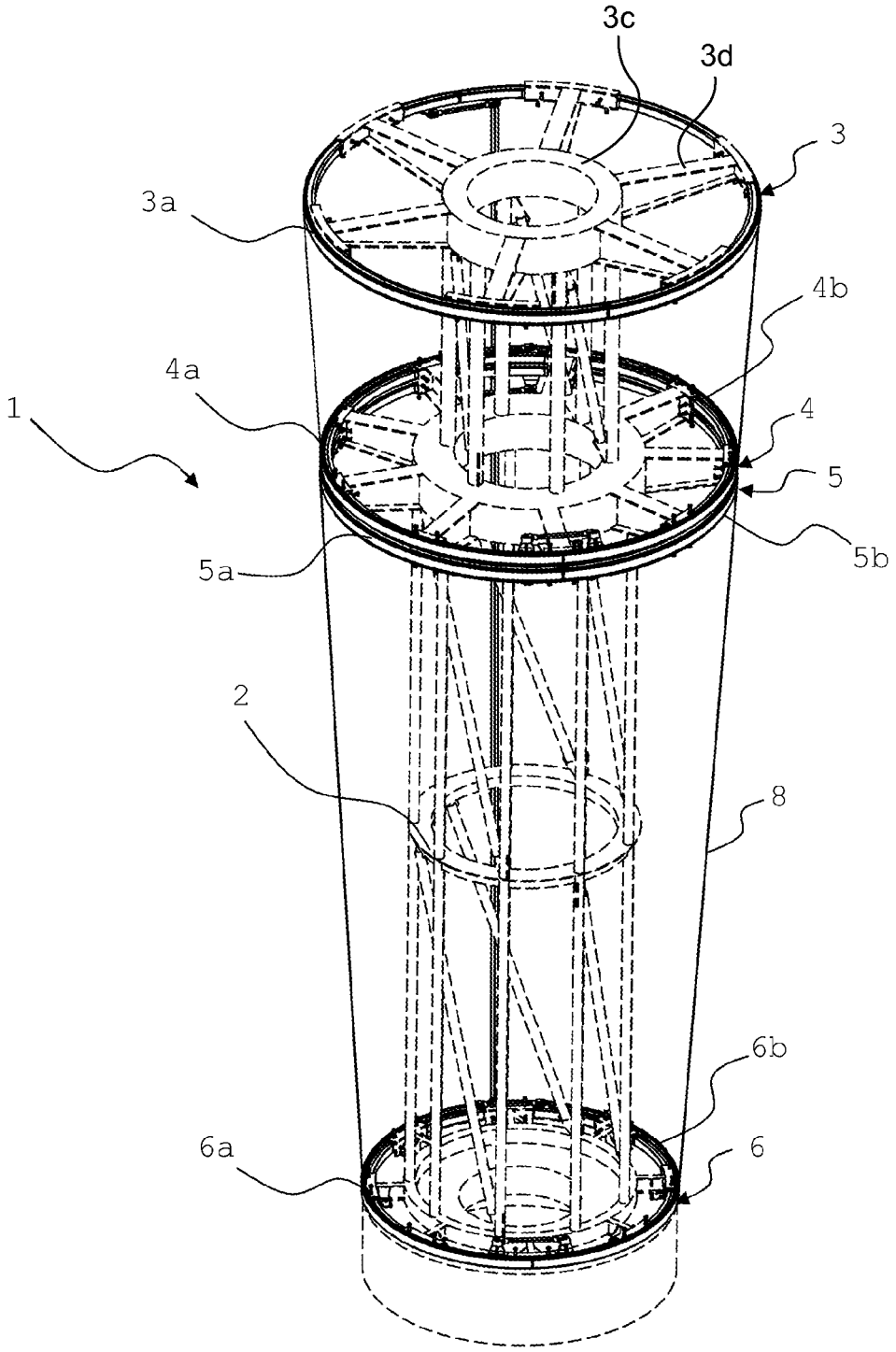
FIG. 1 shows a first embodiment of a radome, which comprises a support frame, carrying four tensioning profiles, which, in pairs, support and tension a radome fabric.
Figure 2:
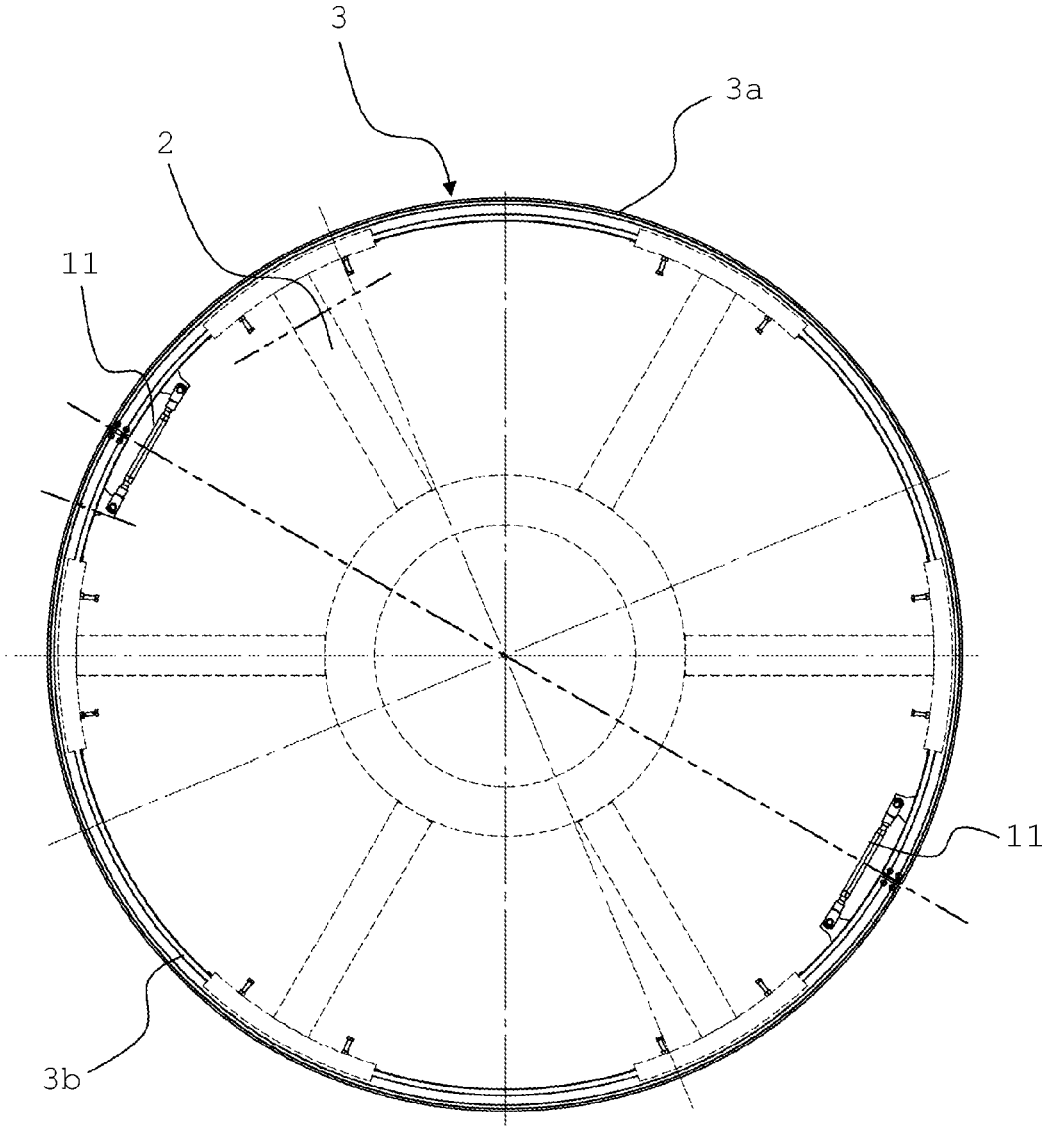
FIG. 2 shows a substantially circular tensioning profile.
Figure 3:
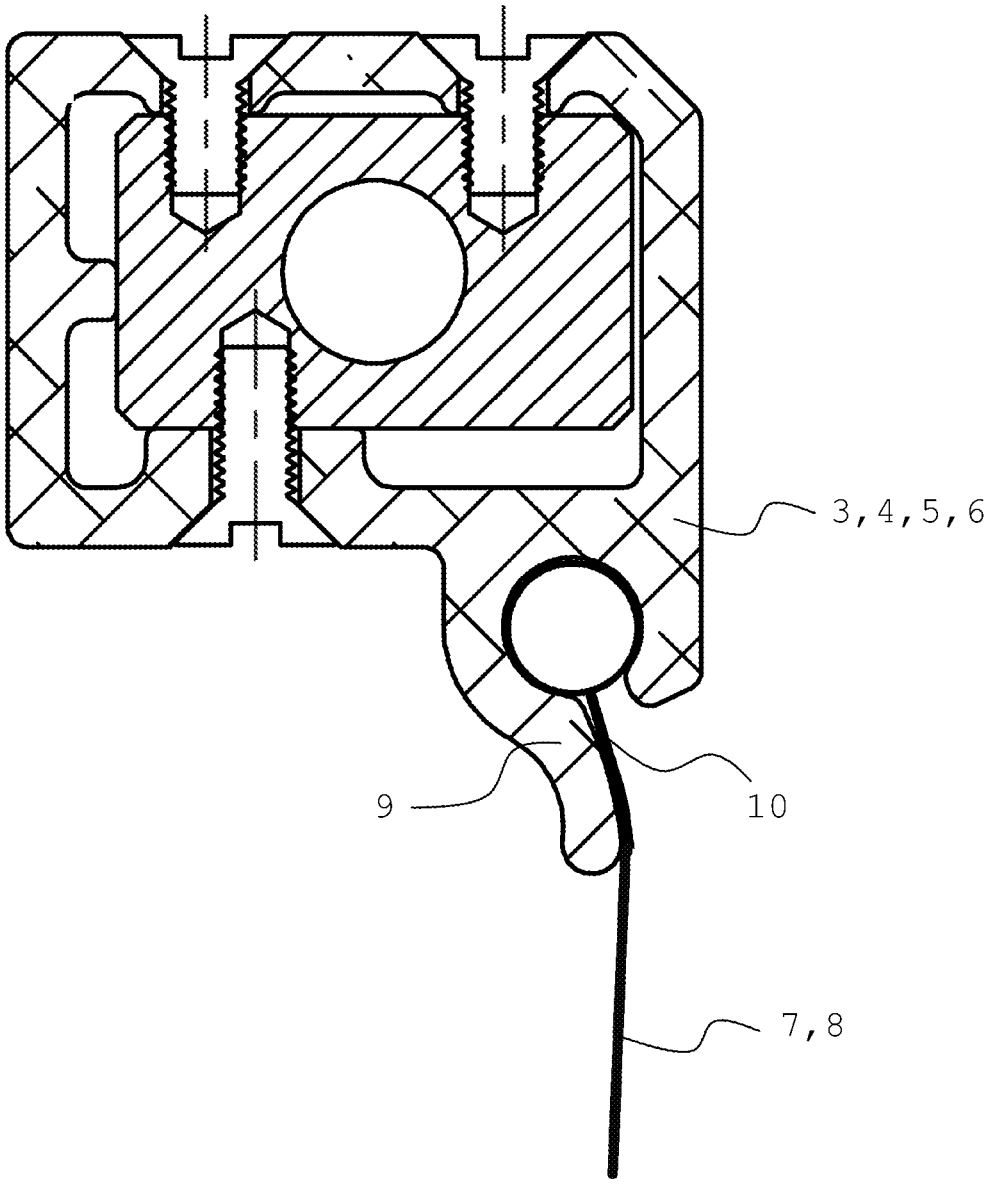
FIG. 3 shows a cross section of a tensioning profile to which an edge portion of a radome fabric is attached.

The radome 1 comprises a support frame 2 in the form of a framework, carrying four tensioning profiles 3-6, which, in pairs, support and tension a radome fabric 7, 8, wherein a first, upper tensioning profile 3 and a second, lower tensioning profile 4 support and tension an upper, first radome fabric 7 in the longitudinal direction of the radome fabric 7, and wherein a third, upper tensioning profile 5 and a fourth, lower tensioning profile 6 support and tension an lower, second radome fabric 8 in the longitudinal direction of the radome fabric 8.

The tensioning profiles 3-6 have a substantially circular shape and are disposed in parallel with each other along a common axis. The tensioning profiles 3-6 may include a central hub 3*c* secured to the framework 2 and radial spokes 3*d* extending from the central hub 3*c* as shown. The first, upper tensioning profile 3 has a circumference that is greater than the circumference of the second, lower tensioning profile 4, and the third, upper tensioning profile 5 has a circumference that is greater than the circumference of the fourth, lower tensioning profile 6. The circumference of the second, lower tensioning profile 4 and the circumference of the third, upper tensioning profile 5 are substantially equal.

The upper, first radome fabric 7, which is tensioned between the first, upper tensioning profile 3 and the second, lower tensioning profile 4 in the longitudinal direction of the radome fabric 7, forms a conical surface, or an envelope surface, and extends between a first plane, which is defined by the first, upper tensioning profile 3, and a second plane, which is defined by the second, lower tensioning profile 4.

The lower, second radome fabric 8, which is tensioned between the third, upper tensioning profile 5 and the fourth, lower tensioning profile 6 in the longitudinal direction of the radome fabric 8, forms a conical surface, or an envelope surface, and extends between a third plane, which is defined by the third, upper tensioning profile 5, and a fourth plane, which is defined by the fourth, lower tensioning profile 6.

Accordingly, the radome 1 has the shape of two truncated cones placed on top of each other, where the upper, first radome fabric 7 forms the first conical surface, or the first envelope surface, and where the second, lower radome fabric 8 forms the second conical surface, or the second envelope surface.

The respective tensioning profile 3-6 each comprises a semi-circular first tensioning profile member 3*a*, 4*a*, 5*a*, 6*a* and a semi-circular second tensioning profile member 3*b*, 4*b*, 5*b*, 6*b*, which tensioning profile members 3*a*-6*a* and 3*b*-6*b* are displaceable relative to each other in at least one of the planes of the tensioning profiles 3-6 to enable the radome fabric 7, 8 to be tensioned in the transverse direction of the radome fabric 7, 8. The displacement between the first tensioning profile member 3*a*-6*a* and the second tensioning profile member 3*b*-6*b* is achieved in that a stretching screw 11 is disposed at each joint between the two tensioning profile members 3*a*-6*a* and 3*b*-6*b*.

The upper tensioning profile 3, 5 and the lower tensioning profile 4, 6 are displaceable relative to each other in axial direction to enable the radome fabric to be tensioned in the longitudinal direction of the radome fabric. The axial displacement is achieved in that the tensioning profiles 3, 4, 5, 6 are displaceable from the support frame 2 by means of adjusting screws.

Each of the tensioning profiles 3-6 comprises a fabric contact portion 9, which exhibits a convex contact surface 10 for interacting with an edge portion at the edge of the radome fabric 7, 8 on the inside of the radome fabric 7, 8, which inside faces toward the support frame 2. The contact surface 10 extends substantially around the entire circumference of the tensioning profile and contributes to relieving the forces on the radome fabric 7, 8, so that the risk of the radome fabric tearing is reduced. The convex contact surface 10 in the longitudinal direction of the radome fabric 7, 8 can have a length between 2-100 mm, or even longer, above 100 mm. A length of the contact surface between 20-50 mm is most practical for absorbing loads during radial tensioning, and allows the structure to withstand large wind loads without any large point loads arising, and that the risk of rotation of the radome fabric, which can cause wear, is reduced.

In the foregoing, the invention has been described based on a specific embodiment. It is appreciated, however, that also other embodiments and variants are possible within the scope of the following claims.

The invention claimed is:

1. A tensioning device for tensioning a radome fabric having an edge portion, the device comprising:

a support frame formed by a framework;

a substantially circular, upper tensioning profile and a substantially circular, lower tensioning profile, which is disposed in parallel with and axially displaced relative to the upper tensioning profile, the upper and lower tensioning profiles being secured to the framework, the radome fabric being secured to and extending between the tensioning profiles, wherein the upper tensioning profile is axially displaceable in multiple increments relative to the support frame and the lower tensioning profile such that the radome fabric is tensioned longitudinally in order to form a radome, wherein at least one of the tensioning profiles comprises a fabric contact channel including an opening defined by an inside leg and an outside leg for receiving the edge portion of the radome fabric, the inside leg of the fabric contact channel including a convex contact surface for interacting with the edge portion of the radome fabric on an inside thereof, wherein the convex contact surface extends in a longitudinal direction of the radome fabric as support for the edge portion of the radome fabric beyond the opening in the fabric contact channel and beyond the outside leg.

2. The tensioning device according to claim 1, wherein said convex contact surface has a length, in the longitudinal direction of the radome fabric, which is between 2-100 mm.

3. The tensioning device according to claim 1, wherein said contact surface extends substantially around the entire circumference of the tensioning profile.

4. The tensioning device according to claim 1, wherein said upper tensioning profile has a diameter that is greater than the diameter of said lower tensioning profile.

5. The tensioning device according to claim 1, wherein at least one of the tensioning profiles comprises a semi-circular, first tensioning profile member and a semi-circular, second tensioning profile member, and wherein the first and second tensioning profile members are displaceable relative to each other in a plane of the tensioning profiles to enable tensioning of the radome fabric in a transverse direction of the radome fabric.

6. The tensioning device according to claim 1, wherein said convex contact surface has a length, in the longitudinal direction of the radome fabric, which is between 20-50 mm.

7. The tensioning device according to claim 1, wherein the edge portion of the radome fabric comprises a circular member attached to the radome fabric, wherein the opening is smaller than a diameter of the circular member.

8. The tensioning device according to claim 1, wherein the upper and lower tensioning profiles comprise a central hub secured to the framework and radial spokes extending from the central hub.

9. A tensioning device for tensioning a radome fabric, the device comprising: a substantially circular, upper tensioning profile and a substantially circular, lower tensioning profile, which is disposed in parallel with and axially displaced relative to the upper tensioning profile, the radome fabric being secured to and extending between the tensioning profiles, wherein the upper tensioning profile is axially displaceable relative to the lower tensioning profile such that the radome fabric is tensioned longitudinally in order to form a radome, wherein at least one of the tensioning profiles comprises a fabric contact portion, which comprises a convex contact surface for interacting with an edge portion of the radome fabric, and wherein at least one of the tensioning profiles comprises a semi-circular, first tensioning profile member connected to a semi-circular, second tensioning profile member, and wherein the first and second tensioning profile members are displaceable relative to each other in a plane of the tensioning profiles by a stretching screw positioned at joints between the first and second tensioning profile members while the first and second tensioning profile members remain connected while adjustment of the stretching screw enables tensioning of the radome fabric in a transverse direction of the radome fabric.

* * * * *